United States Patent [19]

Carstedt

[11] 4,244,319

[45] Jan. 13, 1981

[54] FLUID DISPENSING APPARATUS

[76] Inventor: Howard B. Carstedt, Rte. 1, Box 208, Loretto, Minn. 55357

[21] Appl. No.: 931,369

[22] Filed: Aug. 7, 1978

Related U.S. Application Data

[63] Continuation-in-part of Ser. No. 715,443, Aug. 18, 1976, Pat. No. 4,104,983.

[51] Int. Cl.[2] ..... B05C 5/02; B05C 17/00

[52] U.S. Cl. ..... 118/411; 118/681; 401/137

[58] Field of Search ..... 222/180, 174; 239/283; 118/3, 411, 415, 315, 410, 710, 681; 401/137, 28

[56] References Cited

U.S. PATENT DOCUMENTS

| | | | |
|---|---|---|---|
| 2,670,102 | 2/1954 | Mangano | 222/525 X |
| 3,420,208 | 1/1969 | Guthrie | 118/411 X |
| 3,424,128 | 1/1969 | Beaman | 118/314 |
| 3,429,482 | 2/1969 | Nord et al. | 222/525 X |
| 3,653,599 | 4/1972 | Mussehl | 239/283 X |
| 3,661,679 | 5/1972 | Law | 118/411 X |

*Primary Examiner*—John P. McIntosh

*Attorney, Agent, or Firm*—Williamson, Baines, Moore & Hansen

[57] ABSTRACT

Apparatus for applying fluid to articles. The apparatus comprises an applicator head, an internally defined cylinder interconnected with a source of fluid pressure, and a reciprocally displaceable piston disposed within the cylinder for selectively engaging articles to directly apply fluid thereto. The piston includes an output orifice at the outer extremity thereof adapted to contact an article when the piston is moved through a predetermined dispensing stroke. The orifice is in fluid flow communication with a dispensing fluid input source. In a single action embodiment the apparatus includes a return spring for resetting the piston after each dispensing operation, and in an alternative double action embodiment fluid pressure is utilized to automatically reset the piston at a preselected instant.

A closure cap on the end of the applicator head opposite the output orifice carries a stop which limits the return stroke of the piston; and the cap is held in place by a mounting bracket used to support the applicator head.

15 Claims, 11 Drawing Figures

FLUID DISPENSING APPARATUS

BACKGROUND OF THE INVENTION

This application is a continuation-in-part of my earlier filed application entitled "Pulsating Glue Head for Folding Machines", issued as U.S. Pat. No. 4,104,983, Ser. No. 715,443 filed Aug. 18, 1976.

This invention relates generally to apparatus for dispensing fluid, such as glue, and applying it to articles. More particularly, the instant invention is related to apparatus for automatically applying a metered amount of a fluid to an article in response to predetermined movement of same.

In the prior art a variety of apparatus has been employed to automatically glue strips of papers or other objects during automated handling of same. For example, spray-type gluers have been associated with printing machines in the prior art. One disadvantage of machines of this character is that usually too large an area is sprayed by the gluer, often resulting in contamination of the conveying apparatus utilized to move the glued objects through the mechanized process. Often spray gluing apparatus becomes jammed as deposits of glue form and dry on the output orifice. Often conventional spray heads are too big or cumbersome to fit between the rollers employed in conventional folding machines and are usually too big to be employed in conjunction with apparatus for printing small magazine or newspaper inserts.

Another type of prior art gluing apparatus simply wipes on glue in the form of a strip during the conveying of an object to be glued through a mechanized process. One problem with this technique is that glue often leaks down the front edge of inerts, and when the papers or other objects are subsequently stacked, the inserts will stick together. A prior art glue dispenser of this nature usually includes a head having a downwardly pointing wiping orifice which contacts the slidably moving object to be glued. Wiping-type glue dispensers of this nature are controlled by a remotely located shut-off valve above the apparatus which can be manipulated to control the flow of glue. However, a problem with apparatus of this nature is that glue often continues to drip or run out of the applicator, eventually jamming the feed machinery. When the glue leaks onto the fold rollers of a folding machine the machine must be stopped so that rollers can be cleaned appropriately, obviously slowing down production. In order to overcome the latter problem, it has been known in the fold rolling art to provide a circumferential groove in the fold rollers to avoid mechanical contact with the strip of glue applied to the conveyed objects. The strip will normally line up with the roller groove to prevent contact, but deviation from ordinary roller alignment presents problems. Of course grooved rollers must be changed where not suited for other jobs with which the rolling machine may be employed.

SUMMARY OF THE INVENTION

The instant invention comprises apparatus for the spot application of fluids such as glue, epoxy, liquid mastic and liquid solvent to objects or articles conveyed through an automated process, with the positive shut-off of fluid flow from the applicator after a metered amount has been applied.

In a preferred form of the invention the apparatus comprises an applicator head in which an internally defined cylinder in fluid flow communication with a source of fluid pressure receives a reciprocally displaceable applicator piston. The piston is responsive to fluid pressure to briefly contact an object to thereby apply a spot of fluid to a precisely formed and controlled area. In gluing applications, this achieves "spot gluing". The piston is preferably provided with an elongated, tubular shank portion defining a fluid output orifice and passageway and a circumferential, fluid receptive groove defined in the shank. The groove is in fluid flow communication with the output orifice and passageway. When the piston is in the inoperative rest position, the groove will be substantially sealed by gaskets associated therewith to prevent the outputting and leakage of fluid, such as glue. However, when the piston is actuated to its dispensing position, the receptive groove will be substantially aligned with an adjacent input port thereby allowing pressurized fluid to be forced through the output orifice to spot apply fluid to the object contacted by the shank. In this manner, precise outputting of fluid is accomplished while at the same time preventing leakage or spillage.

In one form of the invention the outputting piston is provided with a coiled, internally disposed spring for automatically returning it to the reset position after a dispensing operation. In an alternative embodiment of this invention, the cylinder head is provided with a second pressure input line for automatically forcing the piston to the reset position in response to fluid pressure. In each form of the invention a solenoid valve system may be employed to actuate the piston, and means responsive to the position of articles to receive fluid are provided for actuating the apparatus.

Thus, a broad object of this invention is to provide a system for the spot application of a controlled amount of fluid to an object or article.

Another object of this invention is to provide means for precisely and accurately applying glue to objects or articles moving through an automated process. It is a feature of this invention that only spots of glue are applied to objects, rather than the strips of glue characteristic of the prior art.

Still another object of this invention is to provide an automatic, pulsating glue dispensing system which employs a reciprocal piston for precisely outputting glue.

Yet another object of this invention is to provide a dispensing system which is characterized by precise control of fluid outputted thereby and which avoids the leakage or spillage often associated with the prior art. An important feature of this invention is that fluid is forced through the applicator piston only when the piston is displaced in the fluid outputting position.

Another object of this invention is to provide a system of the character described for speeding up the process of gluing in an automated system. An important characteristic of one embodiment of this invention is that pneumatic or hydraulic pressure lines may be employed to quickly move the glue outputting piston between glue dispensing and reset positions.

Another object of this invention is to provide a glue dispensing head of the character described which can be quickly and economically installed on existing machinery such as fold rolling machines or the like.

Yet another object of this invention is to provide a spot gluing system of the character described which is responsive to the position of objects to be glued.

A still further object of this invention is to provide a folding machine with spot gluing apparatus of the character described wherein the spot glue applicator is located between fold rollers and a stop bar and is actuated by a sensor located just in front of the stop bar in the path of movement of printed sheets.

As a further advantageous feature of the fluid applicator disclosed herein, the applicator head or body is so positioned that the aforesaid output orifice is located a predetermined distance from an article to have fluid applied thereto, when the piston is in its rest position. That predetermined distance is substantially equal to the length of the dispensing stroke through which the piston moves as it is displaced from its rest position to its dispensing position. Thus, the output orifice will contact and directly apply glue or other fluid to articles positioned or moving under the applicator.

The applicator of this invention is further distinguished by a closure assembly on the end of the applicator head or body opposite the output orifice which functions to positively seal the end of the body as well as to provide a means to support the body at a desired dispensing location. This is accomplished by an elongated mounting bracket which is rigidly secured to the applicator body and also affixed to a removable end cap in sealing engagement with the end of the body.

These and other objects and advantages of this invention, along with features of novelty appurtenant thereto, will appear or become apparent in the course of the following detailed description.

BRIEF DESCRIPTION OF THE DRAWINGS

In the following drawings, which form a part of the specification and are to be construed in conjunction therewith, and in which like reference numerals have been employed throughout to indicate like parts in the various views.

DETAILED DESCRIPTION OF THE DRAWINGS

Figure 1:
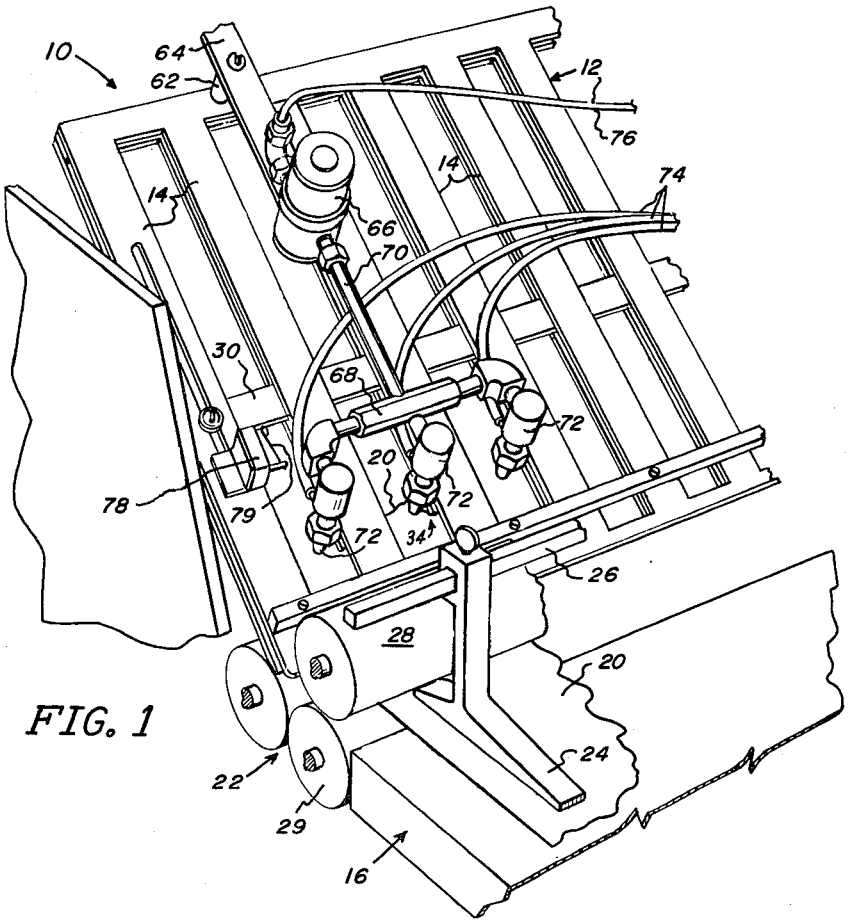
FIG. 1 is an abbreviated perspective view of a feed roller machine equipped with spot gluing apparatus constructed in accordance with the teachings of this invention.

Referring initially to FIG. 1 there is illustrated a folding machine on which glue dispensing apparatus constructed in accordance with the teachings of this invention has been operatively mounted. The feed roller machine 10 comprises a generally upwardly inclined, planar folding plate 12 comprised of a plurality of spaced apart ribs 14 which are inclined with respect to a lower, horizontally disposed, stationary feeder table 16. A sheet of paper (or similar article) 20 is being drawn into the roller assembly 22 between feeder table 16 and a sheet guide 24. The guide 24 comprises a generally inverted T-shaped structure which is clamped at a desired position upwardly from feed table 16 to a transverse support frame member 26. Sheet 20 is initially drawn into the apparatus when it contacts a first roller 28, which urges it inwardly into the mouth of the apparatus until an edge of the paper contacts a stop bar 30 disposed transversely along holding plate 12. As will be described in more detail subsequently, a spot gluing assembly 34 is rigidly mounted with respect to folding plate 12 at a preselected, critical distance above the edge of the sheet 20 progressing through the apparatus.

Figure 2:
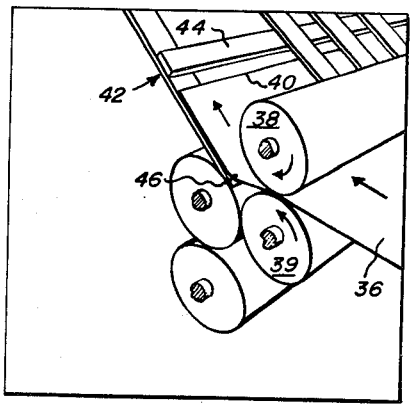
FIG. 2 is an abbreviated, diagrammatic view illustrating the basic operation of a folding machine.
Figure 3:
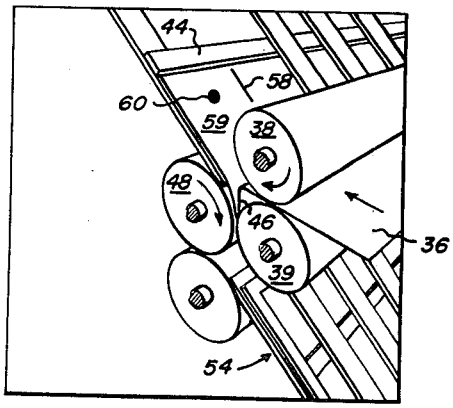
FIGS. 3 through 5 are views similar to FIG. 2 showing later steps in the folding process.
Figure 4:
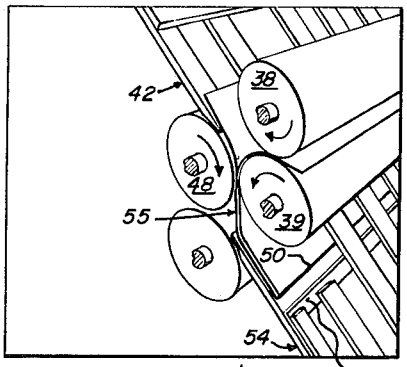
Figure 5:
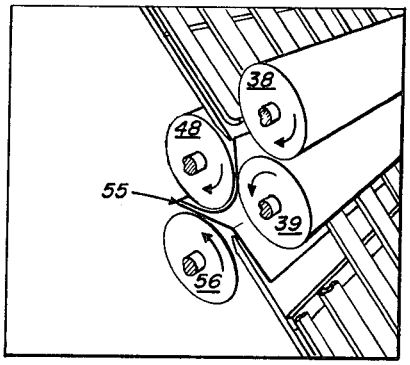

Referring now to FIGS. 2 through 5, the basic operation of a folding machine is illustrated. In FIG. 2 a sheet of paper 36 (or similar article to be folded and glued) has been drawn into the folding apparatus between roller wheels 38 and 39. The leading edge 40 of sheet 36 will be propelled along folding plate 42 into contact with a transverse fold plate gauge bar 44 which stops linear travel of the sheet 36 and cause the formation of a buckle or fold 46. As illustrated in FIG. 3, fold 46 will then be drawn between rollers 48 and 39 until the leading edge 50 (FIG. 4) of the fold contacts a similar fold plate gauge 52 associated with lower fold plate 54. Contact of edge 50 with fold plate gauge 52 will facilitate the formation of a subsequent buckle 55, which will be pulled between rollers 48 and 56 thereby forming another fold. It will be apparent to those skilled in the art that where folding machines of this general type are employed, additional rollers and associated apparatus will be employed to generate the desired number of folding operations.

Before the buckle is drawn into the rollers to form the desired fold, a surface of the paper to be folded is preferably glued so that the article or paper will be maintained in the desired folded position. Referring now to FIG. 3, there is illustrated an elongated, glue strip 58 applied to an inner surface 59 of the paper 36. Glue strip 58 is characteristic of prior art, wiping-type glue applicator techniques, wherein a glue head frictionally contacts surface 59 of the paper as it is drawn into the rolling wheels 48 and 39. It will be apparent to those skilled in the art that one problem with gluing of this type is that the glue strip 58 is so long that it very likely may contact the outer circumferential surface of drum roller 38, thereby contaminating same and causing it to stick to subsequently introduced paper. On the other hand, there is also illustrated in FIG. 3 a glue spot 60 of the type applied by applicant's spot gluing apparatus to be hereafter described. It will be apparent to those skilled in the art that the limited dimensions of glue spot 60 prevent contact with roller 38, although facilitating proper gluing of the paper during the folding operation already discussed.

In FIG. 1 one form of applicant's invention is illustrated attached to the folding machine 10. Applicant's gluing apparatus 34 is supported a predetermined distance above the surface of the paper 20 being introduced into the apparatus by a spacer 62 which offsets a support frame number 64. The apparatus comprises a pressure control valve 66, preferably in the form of a solenoid valve, which is attached to a pressure manifold 68 through an elongated, rigid tubular pipe 70. Manifold 68 includes a plurality of spot gluing applicator heads 72, each of which is in fluid flow communication with pressure supplied through the manifold 68. Each applicator head is also connected to a conventional glue supply through hoses 74. The solenoid valve 66 is in fluid flow communication with an external pressure supply through a line 76. Although it is contemplated that a pneumatic system shall be employed, it will be recognized by those skilled in the art that any form of fluid pressure actuation such as a hydraulic system will be equally advantageous. There is also illustrated a trigger means 78 which is secured to the folding plate 12 near the folding plate gauge 30. Trigger means 78 activates solenoid 66 and is preferably in the form of a microswitch, which has a small trigger portion 79 thereof disposed near stop gauge 30 to contact the leading edge of the paper being drawn through the apparatus to thereby initiate gluing in response to a predetermined movement or position of the paper being conveyed through the folding apparatus.

Figure 6:
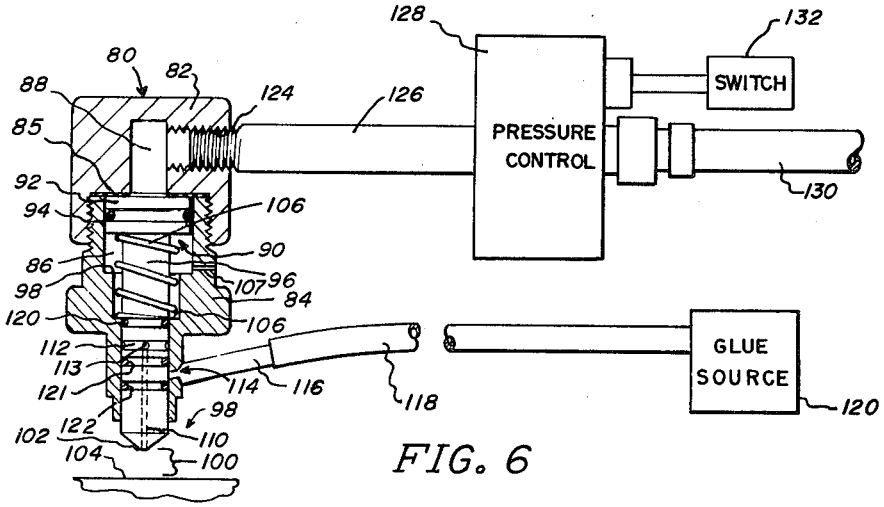
FIG. 6 is a block diagram of gluing apparatus constructed in accordance with the teachings of this invention, showing a single action fluid applicator head in section.
Figure 7:
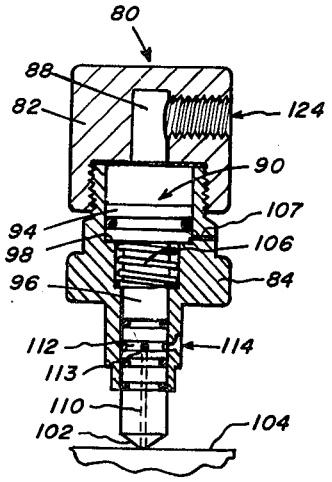
FIG. 7 is a sectional view of the applicator head in FIG. 6 disposed in the operative, spot applicating position.

In FIGS. 6 and 7 a single action spot gluing applicator head 80 is illustrated in detail. Head 80 preferably comprises an upper, threaded fitting 82 which matingly receives a lower threaded fitting 84. Fittings 82 and 84 are preferably of brass construction. A circumferential gasket 85 provides an airtight seal between the fittings. An elongated, generally cylindrical cylinder 86 is defined within head fitting 84, and is in fluid flow communication with passageway 88 in the upper fitting 82. A piston assembly 90 is reciprocally disposed with cylinder 86 for movement between a sealed rest position illustrated in FIG. 6 and the operative glue dispensing position illustrated in FIG. 7. Piston assembly 90 comprises a piston 92 of a diameter substantially equal to the internal diameter of cylinder 86, and includes a sealing ring 94 seated in a circumferential groove defined therein for sealing the piston in a normal manner. The piston assembly also includes an elongated shank portion 96 which is attached to piston 92 and which exits from the lower end 98 of head portion 84 to contact the paper (or other article or object) to be glued.

A shoulder 98 formed in cylinder 86 limits piston travel by contacting the underside of piston 92. Importantly, the distance 100 between the glue output orifice 102 in the piston shank and an object 104 to be glued should be adjusted by the operator to approximately equal the distance between the underside of piston 92 (when in the rest position) and cylinder shoulder 98. A preferably coiled spring 106 is wound about shank 96 and is disposed between the underside of piston 92 and a second lower recessed shoulder portion 106. After piston 92 has been deflected downwardly, as illustrated in FIG. 7, spring 106 will automatically reset the piston for a subsequent gluing operation. Passageway 107 vents cylinder pressure prior to piston resetting.

Glue is outputted through the piston assembly through an elongated glue output passageway 110 which extends vertically upwardly through the center of shank 96 and which is in fluid flow communication with a circumferential, glue receptive groove 112 provided in shank 96. To this end an orifice 113 drilled through the shank inter-communicates groove 112 and passageway 110. When the piston is displaced downwardly groove 112 will be positioned interiorly adjacent a glue input port 114 provided at the lower end of head cap portion 84. A suitable liquid glue is delivered to orifice 114 through a preferably brass fitting 116 and a glue line 118 which is in fluid flow communication with a conventional source of glue 120. As best shown in FIG. 7, when the piston is deplunged within the cylinder it will be apparent that glue entering orifice 114 under pressure will be outputted through passageway 110, passing through groove 112 via orifice 113. However, when the piston is in the sealed rest position illustrated in FIG. 6 (i.e., after the piston is reset), glue will be prevented from dripping out of the apparatus by a plurality of spaced apart sealing rings 120, 121 and 122. Ring 122 will of course prevent glue from dripping downwardly from orifice 114 when the piston is reset. Sealing ring 121 will prevent the passage of glue past the glue receptive groove 112, while sealing ring 120 will provide an effective seal between cylinder 86 and groove 112.

Pressure, preferably pneumatic, is delivered to applicator head 80 through a threaded fitting 124 received by head cap portion 82. Fitting 124 is in fluid flow communication through a line 126 with a conventional source of pneumatic pressure 128. It is contemplated that pressure source 128 will be in the form of a conventional air solenoid valve which receives pressure via a line 130 from a conventional air pressure source (not shown). Solenoid 128 is actuated by a switch 132 which will be mechanically positioned in order to trip the solenoid in response to a predetermined movement of an object to be glued. For example, the microswitch 78 (equivalent to switch 132) illustrated in FIG. 1 has been fastened to the apparatus near the stop gauge 30 so that switch element 79 which projects towards the stop gauge will contact the leading edge of paper to suitably actuate the apparatus. A type 8345 ASCO midget valve available from the Automatic Switch Company, Florham Park, N.J. 07932, will suitably perform the task of selectively delivering air to line 126 in response to the switch 132.

Figure 8:
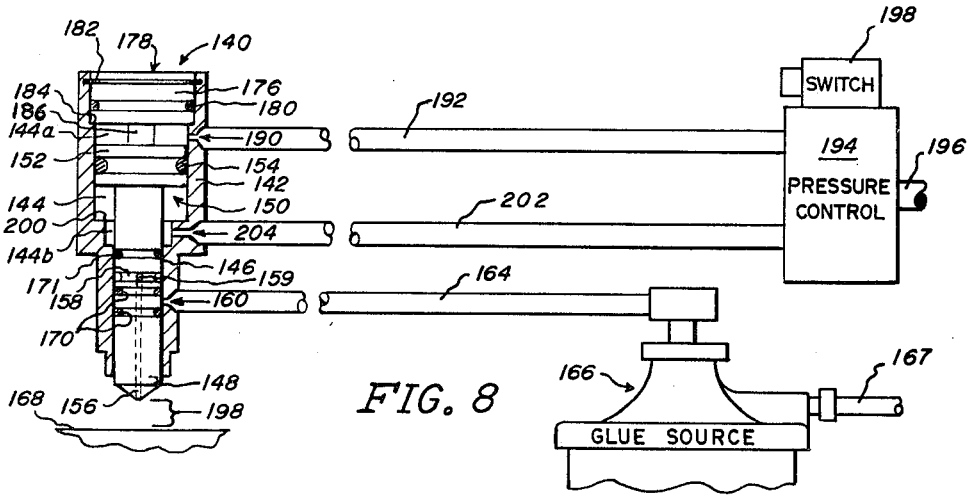
FIG. 8 is a block diagram of a preferred embodiment of applicator apparatus constructed in accordance with the teachings of this invention, and showing a double action applicator head in section.
Figure 9:
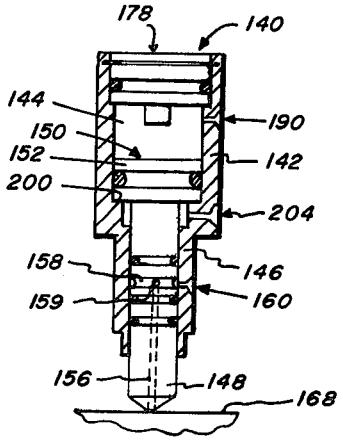
FIG. 9 is a sectional view of the applicator head in FIG. 8 disposed in the operative, spot applicating position.

Referring now to FIGS. 8 and 9, there is seen an alternative embodiment of this invention comprising a double action applicator head 140. Head 140 preferably comprises an elongated, generally cylindrical housing 142 which includes an internally defined cylinder 144 and a somewhat lesser diameter portion 146 thereof. An elongated shank portion 148 of the piston assembly 150 disposed within cylinder 144 penetrates cylinder portion 146. Assembly 150 includes a piston 152 which is reciprocally movable within cylinder 144, being sealed within same by a circumferential sealing ring 154. Shank 148 is integrally attached to piston 152 and extends downwardly through the housing 142 to the exterior of the head. Extending centrally through the lower portion of shank 148 is an elongated glue output passageway 156 which is in fluid flow communication with a glue receptive groove 158 provided in shank 148 via a passageway 159. As best seen in FIG. 9, when piston 152 is despressed or actuated, the glue receptive groove 158 will be internally positioned adjacent a glue input orifice 160 provided in housing 146, and which is in fluid flow communication via a line 164 with a conventional pressurized glue source 166. Thus, when the piston is actuated glue will be forced through line 164, orifice 160, groove 158, and outputted through passageway 156 which will be in contact with an article 168, comprising a sheet of paper or the like. Shank 148 includes a pair of spaced apart sealing rings 170 which prevent leakage of glue, and an upper sealing ring 171 which provides a seal between cylinder 144 and groove 158.

Housing 142 is sealed by an upper cap 176 which is fitted within the upper orifice 178 in housing 142 and which is in turn sealed by a circumferential sealing ring 180. A circumferential clip 182 maintains cap 176 in position against an upper shoulder 184. A shank portion 186 descending downwardly from cap 176 contacts piston 152 to maintain it in correct position when in the reset or rest position. The upper cylinder volume 144*a* is in fluid flow communication with a source of pressure through an orifice 190 which communicates with a line 192 in fluid flow communication with pressure source 194. Source 194 preferably comprises a four-way solenoid valve, such as an ASCO type 8345, four-way midget valve, available from Automatic Switch Company, Florham Park, N.J. Valve 194 is preferably connected to a conventional source of pressure through a conventional pressure line 196, and valve 194 is suitably actuated in response to predetermined movement of an object to be glued by switch 198. Switch 198 may be a conventional electrical switch such as a microswitch or the like and it may include electronic transistor circuitry as will be recognized by those skilled in the art. Switch 198 should also be located appropriately as discussed earlier in conjunction with equivalent switch 78 in FIG. 1.

When the switch 198 senses the movement of an object to be glued, the solenoid 194 will be actuated thereby pressurizing line 192 to depress piston 152. When this occurs glue receptive groove 158 will be positioned adjacent glue input orifice 160 so that glue will be forced through passageway 156 and thereby spot glue the object 168. It should be noted that the head 140 should be positioned a preselected distance 198 (FIG. 8) away from object 168. Distance 198 is of course equal to the distance between the lower piston surface and the deflection limiting shoulder 200.

A second pressure input line 202 supplies pressure from pressure control valve 194 to a cylinder orifice 204 in order to selectively reset the piston assembly 150 by forcing it upwardly into contact with shank 186. It will be observed in FIG. 9 that when the piston assembly is in the operative glue dispensing position, pressure subsequently supplied to lower cylinder volume 144*b* will drive piston 152 upwardly, thereby resetting the head after each gluing operation. The preferably four-way configuration of valve 194 facilitates selective pressurization of 192 and 202 as will be recognized by those skilled in the art.

Where a large area of paper or other article to be glued is necessary, a plurality of applicator heads may be connected to a manifold and operated in parallel, as illustrated generally in FIG. 1, wherein a manifold 68 operates a plurality of applicator heads 72. In the latter case the glue input lines will be paralleled, and the pressure input lines will be paralleled. It has been found by applicant that the double action glue applicator 140 functions significantly quicker than the single action head 80. Thus, where relatively slow processing apparatus is employed the less expensive applicator head 80 will be suitable. However, where large numbers of articles or objects to be glued must be handled very quickly then the faster applicator head 140 has been found desirable. When associated with a folding machine 10 either one of the applicator heads 80 or 140 have been found to provide very dependable and reliable results.

Figure 10:
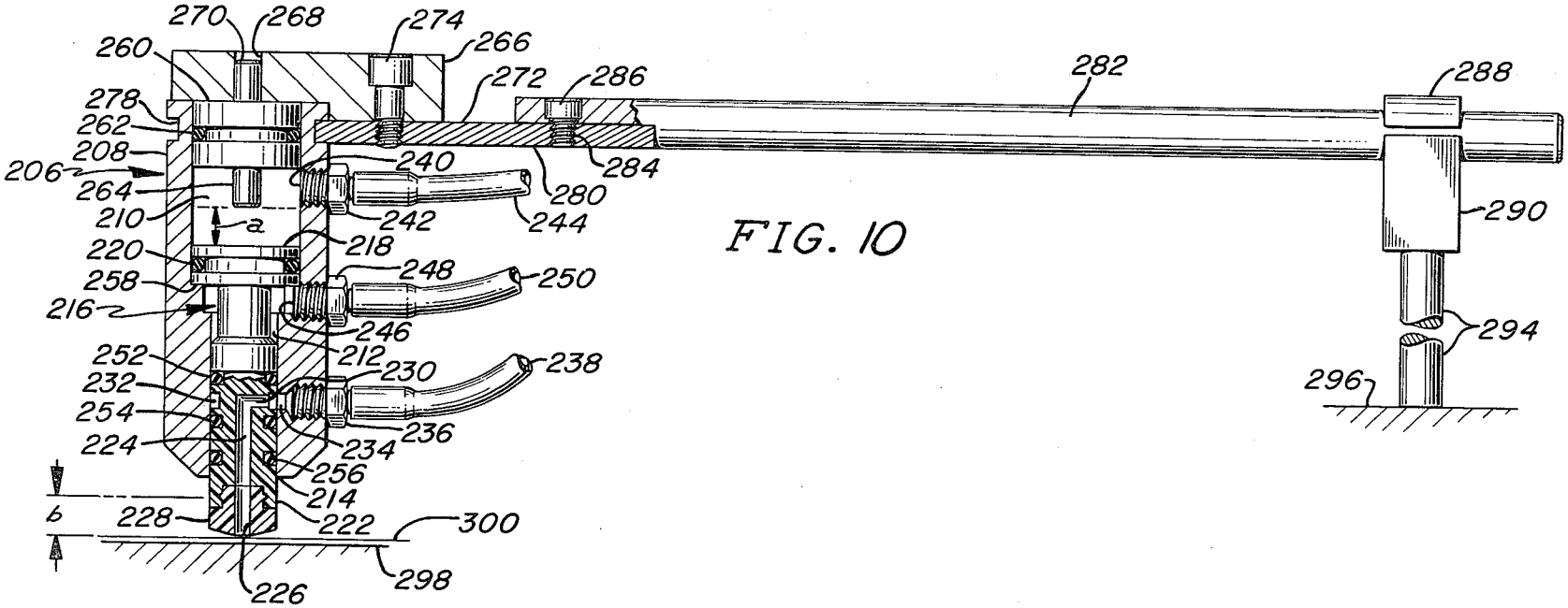
FIG. 10 is a side elevation view of a mounting arrangement for a modified version of the fluid applicator which is shown in section.
Figure 11:
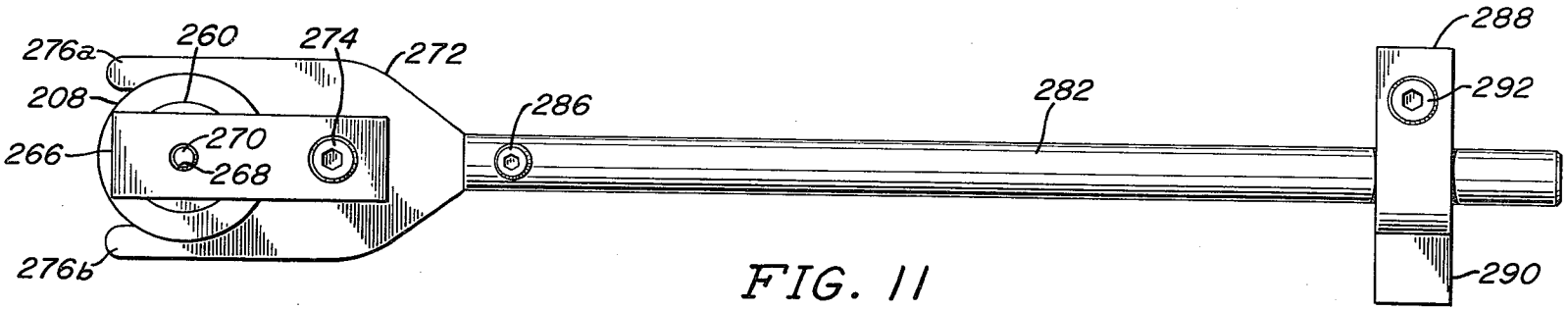
FIG. 11 is a top, plan view of the fluid applicator apparatus of FIG. 10.

In FIGS. 10 and 11 I have shown a modified version of the fluid applicator of this invention. The fluid applicator is indicated generally by reference numeral 206, and is of the double acting type similar to that disclosed in FIGS. 8 and 9. A special end closure and mounting bracket assembly is provided to more positively hold an end cap in place and to facilitate mounting of the applicator. The applicator body 208 is preferably of cylindrical shape, although a tubular body of square or rectangular cross section could also be utilized. Body 208 defines an inner, cylindrical space 210 at the upper end of the applicator, which opens into a lesser diameter, cylindrical portion 212 in the lower end of the body 208. Cylindrical portion 212 terminates at its lower end at an output end having an open bottom 214.

A piston unit generally indicated by reference numeral 216 is slidably mounted within cylindrical spaces 210, 212 for reciprocal movement therein along the longitudinal axis of body 208. Piston unit 216 includes a piston head 218 at its upper end which reciprocates within cylindrical space 210, and is sealed to the side walls thereof by a sealing ring 220. The piston unit 216 further includes an elongated shank portion 222 extending within cylindrical body portion 212 and projecting outwardly beyond the bottom opening 214 thereof. A flow passage 224 extends longitudinally within tubular shank 222, and defines at its outer or lower end extremity a fluid output orifice 226. Orifice 226 is preferably formed in a separate, discharge nozzle 228 which can be removably inserted in the bottom end of piston shank 222 in a snap fit with a recess therein. The use of a removable discharge nozzle 228 permits output orifices of various shapes to be utilized, as required for the dispensing of different fluids for particular applications. A short passage 230 extends from the upper end of flow passage 224 laterally to the periphery of piston shank 222 in fluid flow communication with peripheral passage means on shank 22 in the form of a circumferential groove 232. An input port 234 is formed in applicator body 208 to receive fluid to be dispensed. Port 234 is preferably threaded to receive a fitting 236 connected by a flexible tube 238 to a pressurized source of fluid to be dispensed. For example, tube 238 could be connected to a container of glue, under pressure, as is indicated with respect to connecting tubing 164 and glue source 166 in FIG. 8. Groove 232 in piston shank 222 will be aligned with port 234 to receive fluid from tube 238 when piston unit 216 is in the fluid dispensing position shown in FIG. 10.

Piston 216 is shifted between rest and fluid dispensing positions by fluid pressure. To that end, a first inlet opening 240 is provided in body 208 above piston head 218. Fitting 242 is threadedly attached within inlet opening 240, and has a flexible tube 244 attached thereto for connection to a source of actuating fluid, such as air under pressure. Pneumatic actuation is preferred for the applicator. A second inlet opening 246 is formed in body 208 at a spaced apart location thereon from inlet opening 240 for delivering pressurized, actuating fluid into the bottom end of cylindrical chamber 210 beneath piston head 218. A fitting 248 within inlet opening 246 is connected by means of flexible tubing 250 to a source of pressurized actuating fluid. Preferably, pressure lines 244 and 250 are connected through a common control valve to a source of pressurized air, as is indicated with respect to pressurizing lines 192, 202 and pressure controller 194 in FIG. 8. An upper sealing ring 252 on piston shank 222 prevents the leakage of air or dispensing fluid along shank 222 to or from upper cylindrical chamber 210. A pair of lower sealing rings 254 and 256 preclude leakage of dispensing fluid from input port 234 along piston shank 222.

The downward movement of piston head 218 on its dispensing stroke is limited by a stop shoulder 258 formed on the lower end of cylindrical chamber 210. The return stroke of piston head 218 is limited by stop means on an end closure cap 260 so as to locate piston head 218 at a desired, rest position. To that end, closure cap 260 has an elongated stop member 264 depending downwardly therefrom along the longitudinal axis of applicator body 208 within cylindrical chamber 210. Stop member 264 is of lesser width than cap 260 and is of such a length that the upper end of piston head 218 is stopped by contact therewith on its return stroke in a rest position, as indicated by a dotted line in FIG. 10. When piston head 218 is in that rest position, it will define with the bottom end of closure cap 260 a pressurizing chamber in fluid flow communication with actuating fluid inlet opening 260. Cap 260 is provided with a sealing ring 262 and serves to seal the upper end of applicator body 208.

Cap 260 forms part of a top closure assembly which further includes the mounting member in the form of an elongated block 266. An aperture 268 in block 266 receives a mounting pin 270 in a force fit therewith, whereby mounting block 266 is joined to closure cap 260 for removal and mounting therewith. Elongated block 266 extends laterally over the top end of applicator body 208 and projects to one side thereof over an elongated mounting bracket 272. Block 266 rests at its outer end on mounting bracket 272 and is affixed thereto by a threaded fastener in the form of a socket, cap screw 274 at a location spaced to one side of body 208. Mounting bracket 272 is bifurcated at one end thereof to provide mounting fingers 276*a* and 276*b* which securely embrace body 208 within a groove 278 formed in the upper end thereof. Mounting bracket 272 is thereby restrained against upward movement along the longitudinal axis of applicator body 208. With elongated block 266 being affixed to bracket 272 at one end thereof, and joined to closure cap 260 at its opposite end through a force fit with pin 270, closure cap 260 will be positively restrained against displacement longitudinally of body 208 under the force exerted thereon by piston head 218 when it strikes stop member 264 on its return stroke. This end closure and mounting assembly has proven to be a very effective way for sealing the upper end of applicator body 208 and for preventing displacement of closure cap 260.

A further benefit from the aforesaid end closure assembly resides in the utilization of mounting bracket 272 for mounting and supporting applicator 206. For this purpose, bracket 272 is provided with a mounting arm 280 on its free end by means of which it may be attached to a support device. Such a support device may take the form of the elongated support bar 282 shown in FIGS. 10 and 11. Mounting arm 280 of bracket 272 has a threaded hole 284 by means of which it is secured to support bar 282 by a threaded fastener 286 extending therethrough. Horizontally extending support bar 282 may be in turn mounted on any type of upright support device. For this purpose, an adjustable clamp 288 may be utilized in combination with a clamping block 290. Clamp 288 fits over the top of bar 282 and is secured in place in clamping engagement therewith by a screw 292 extending into cooperating, clamping block 290. Block 290 is in turn mounted on an upright rod 294, which can be attached to any type of horizontal, base support as indicated generally by reference numeral 296.

It is anticipated that mounting bracket 272 may be utilized to secure fluid applicator 206 to various types of support devices. For example, support bar 282 could be in the form of a handle which can be held in an operator's hand for manual positioning and utilization of applicator 206.

In operation, applicator 206 will normally be supported from mounting bracket 272 and support bar 282 at a desired location for applying fluid to articles. In FIG. 10, numeral 298 indicates a surface for supporting articles to have fluid applied thereto; and an article thereon is designated by reference numeral 300. As shown in FIG. 10, article 300 is a sheet of material, which could be paper, fiberboard to be glued, or any other sheet type of article requiring the spot application of fluid thereto. In addition to glue, the applicator disclosed herein may be utilized for dispensing a metered amount of many other fluids, including epoxy, liquid solder flux, vaseline, liquid mastic and liquid solvent. Applicator body 208 will normally be positioned by means of mounting bracket 272 and support bar 282 at a predetermined distance above the surface of an article 300 to have fluid applied thereto. This distance will be set so that when piston unit 216 is in its rest position with piston head 218 abutting against the lower end of stop member 264, output orifice 226 will be located a predetermined distance b above article 300. Applicator body 208 is located so that distance b will be substantially equal to, and certainly no greater than, distance a which indicates the length of the dispensing stroke through which piston 216 moves as it is actuated from its rest position against stop member 264 to its fully extended, dispensing position with piston head 218 abutting against stop shoulder 258. FIG. 10 illustrates piston unit 216 in its fully extended, dispensing position. When the applicator 206 is actuated by the introduction of pressurizing fluid through tubing 244, piston 216 will be forced downwardly to its dispensing position by the force of the pressurizing fluid acting on top of piston head 218. When this happens, circumferential groove 232 on piston shank 222 will be aligned with fluid input port 234 to receive fluid from tubular conduit 238. The fluid to be applied will then flow through inlet port 234, lateral flow passage 230, and flow passage 234 within piston shank 222 to output orifice 226. With piston 216 fully extended on its dispensing stroke as shown in FIG. 10, output orifice 226 will just contact article 300 to apply a spot of fluid thereto in a limited area. It is to be noted that the length of the piston dispensing stroke a, and the size of discharge passage 224 and output orifice 226 can be varied to provide a predetermined, metered amount of various types of fluids for particular applications. The introduction of pressurizing fluid through tube 250 and second inlet opening 246 below piston head 218 raises piston 216 on its return stroke. The return stroke is terminated and limited by the contact of piston head 218 with stop member 264, at which point lateral flow passage 230 will be above and out of fluid flow communication with fluid input port 234, and with output orifice 226 elevated above article 300 at distance b.

As noted above, a pressure control valve such as that shown at 194 in FIG. 8 will be utilized to control the flow of pressurizing fluid, preferably air, through tubes 244 and 250 to alternately extend piston 216 on its dispensing stroke and to return it to its rest position on its return stroke. Such a pressure controller can be actuated by a switch 198 responsive to the movement of an article 300 into fluid applying position underneath output orifice 226. This can be accomplished by a microswitch having a sensing finger tripped by the moving article, or by a photoelectric eye. The releasing of the tripping device by the moving article 300 can serve to actuate pressure controller 194 to vent pressurizing inlet opening 240 and to connect inlet opening 246 to the source of pressurizing fluid through tube 250.

It is to be noted that when piston 216 is in its rest position against stop 264, sealing ring 254 will be above fluid inlet port 234 between it and circumferential groove 232. Sealing ring 254 thus functions to prevent the flow of dispensing fluid into groove 232 and out through discharge passage tube 24 to prevent fluid leakage when no dispensing operation is taking place. Also, at this time, sealing ring 256 will be below inlet port 234 to prevent the leakage of fluid down along the inside wall surface of cylindrical space 212 through the open end 214 of applicator body 208. This arrangement of sealing rings 254 and 256 positively prevents the undesired leakage of dispensing fluid. The upward, return stroke of piston 216 creates a suction effect within reduced diameter cylindrical space 212. This further assures the non-drip function of applicator 206, since sealing rings 254 and 256 prevent air from reaching lateral passage 230 and the top of discharge passage 224. Thus, the slight suction effect within discharge passage 224 and the lack of atmospheric pressure therein, will prevent any fluid left in passage 224 after a dispensing operation from dripping downwardly out of output orifice 226.

It is contemplated that applicator 206 and its various components may be made from a variety of materials, including stainless steel and plastic. Also, a brass body and components could be utilized. It is contemplated that various other changes in the size, shape and construction of the fluid applicator disclosed herein may be made without departing from the spirit and scope of the invention as defined by the following claims.

What is claimed is:

1. A fluid applicator comprising:

an elongated, hollow body having an opening at one dispensing end thereof and closure means sealingly covering its opposite end;

an input port in said body for receiving fluid to be dispensed from a pressurized supply;

an inlet opening in said body adjacent said opposite end thereof for connection to a source of pressurized actuating fluid;

an elongated piston reciprocally movable within said body longitudinally thereof between a rest position and a fluid dispensing position in response to actuating fluid introduced through said inlet opening, said piston comprising;

an elongated, tubular shank portion having a groove around its periphery adapted to be interiorly positioned adjacent to said input port when said piston is disposed in said fluid dispensing position;

a flow passage extending longitudinally within said tubular shank portion and defining a fluid output orifice at the outer extremity thereof in fluid flow communication with said groove, said fluid output orifice being the outermost end element on said elongated piston, and said tubular shank portion being moved through said opening at said one dispensing end of said body to a position where said output orifice is freely disposed outside of said body for direct contact with an article to which fluid is to be applied when said piston is moved under the pressure of actuating fluid to said fluid dispensing position;

gasket means for preventing the passage of fluid between said groove and said input port when said piston is in said rest position;

means for returning said piston to said rest position after fluid is dispensed; and said closure means comprises a cap extending transversely across said opposite end of said body in sealing engagement therewith, and means secured to said opposite end of said body and affixed to said cap, whereby said cap is positively restrained against displacement.

2. A fluid applicator as defined in claim 1 wherein:

said piston further comprises a piston head on the end thereof opposite said fluid output orifice; and a stop member of lesser width than said body depends from said cap longitudinally within said body a predetermined distance such that said opposite end of said piston is stopped by contact therewith in said rest position when actuated by said return means to thereby define a pressurizing chamber on one side of said piston head in fluid flow communication with said inlet opening for actuating fluid.

3. A fluid applicator As defined in claim 2 wherein:

a second inlet opening is formed in said body at a spaced apart location along said body from said inlet opening adjacent said opposite end thereof for delivering pressurized fluid into said body on the opposite side of said piston head to thereby serve as said means for returning said piston to said rest position.

4. A fluid applicator as defined in claim 2 wherein:

said means secured to said body comprises a mounting bracket extending generally normal to the longitudinal axis of said body and having one end secured to said body adjacent to said opposite end thereof, and said bracket being affixed to said cap by means of an intermediate mounting member, whereby said mounting bracket positively holds said cap against displacement longitudinally of said body under the force exerted by said piston against said stop member as said piston is returned to said rest position.

5. A fluid applicator as defined in claim 1 wherein:

said gasket means comprises a sealing ring extending circumferentially around said tubular shank portion in sealing engagement with the inside wall surface of said body at a location between said groove and said input port when said piston is in said rest position.

6. A fluid applicator as defined in claim 5 wherein:

a second sealing ring extends circumferentially around said shank portion in sealing engagement with the inside wall surface of said body at a location between said input port and said fluid output orifice when said piston is in said rest position to prevent fluid from leaking from said inlet port out said opening at said dispensing end of said body.

7. A fluid applicator as defined in claim 1 wherein:

said means secured to said body comprises an elongated mounting bracket extending generally normal to the longitudinal axis of said body and having a bifurcated end embracing said body within a circumferential recess in said opposite end thereof, said bracket being affixed to said cap, whereby said mounting bracket positively holds said cap against displacement longitudinally of said body from said opposite end thereof under the forces exerted by said pressurized actuating fluid and by said piston on returning to said rest position.

8. A fluid applicator as defined in claim 7 wherein:

said mounting bracket is affixed to said cap by means of an elongated mounting member extending over said opposite end of said body and joined to said end cap, said mounting member being attached to said mounting bracket at a location spaced to one side of said body.

9. A fluid applicator as defined in claim 8 wherein:

said mounting member is in the form of an elongated block removably attached at one end thereof to said mounting bracket by fastener means and joined to said end cap at its opposite end.

10. A fluid applicator as defined in claim 7 wherein:

said mounting bracket comprises a mounting arm extending from said bifurcated end for attachment to fixed support means or to a handle facilitating manual operation of said fluid applicator.

11. Fluid dispensing apparatus comprising:

an elongated, hollow body having an opening at one dispensing end thereof and closure means sealingly covering its opposite end;

an input port in said body for receiving fluid to be dispensed from a pressurized supply;

an inlet opening in said body adjacent said opposite end thereof for connection to a source of pressurized actuating fluid;

an elongated piston reciprocally movable within said body longitudinally thereof through a predetermined dispensing stroke between a rest position and a fluid dispensing position in response to actuating fluid introduced through said inlet opening, said piston comprising;

an elongated, tubular shank portion having passage means at its periphery adapted to be interiorly positioned adjacent to said input port to receive fluid to be dispensed when said piston is disposed in said fluid dispensing position;

a flow passage extending longitudinally within said tubular shank portion and defining a fluid output orifice at the outer extremity thereof in fluid flow communication with said passage means, said fluid output orifice being the outermost end element on said elongated piston, and said body being so positioned that said output orifice is located a distance from an article to have fluid applied thereto which is no greater than the length of said dispensing stroke, and, said tubular shank portion being moved through said opening at said one dispensing end of said body to a position where said output orifice is freely disposed outside of said body to thereby directly contact an article and directly apply fluid thereto when said piston is moved under the pressure of actuating fluid on said dispensing stroke;

gasket means for preventing the passage of fluid between said passage means and said input port when said piston is in said rest position; and means for returning said piston to said rest position after fluid is dispensed.

12. Liquid dispensing apparatus as defined in claim 11 wherein:

said gasket means comprises a sealing ring extending circumferentially around said tubular shank portion in sealing engagement with the inside wall surface of said body at a location between said passage means and said input port when said piston is in said rest position.

13. Liquid dispensing apparatus as defined in claim 12 wherein:

said piston further comprises a piston head on the end thereof opposite said fluid output orifice; and a stop member of lesser width than said body depends from said closure means longitudinally within said body a predetermined distance such that said opposite end of said piston is stopped by contact therewith in said rest position when actuated by said return means to thereby define a pressurizing chamber on one side of said piston head in fluid flow communication with said inlet opening for actuating fluid.

14. Liquid dispensing apparatus as defined in claim 13 wherein:

a second inlet opening is formed in said body at a spaced apart location along said body from said inlet opening for delivering pressurized fluid into said body on the opposite side of said piston head to thereby serve as said means for returning said piston to said rest position.

15. Liquid dispensing apparatus as defined in claim 11 wherein:

a second sealing ring extends circumferentially around said shank portion in sealing engagement with the inside wall surface of said body at a location between said input port and said fluid output orifice when said piston is in said rest position to prevent fluid from leaking from said inlet port out said opening at said dispensing end of said body.

* * * * *